United States Patent [19]

Arenz

[11] 4,227,827

[45] Oct. 14, 1980

[54] VIBRATORY COMPACTING ROLLER

[75] Inventor: Bruno Arenz, Düsseldorf, Fed. Rep. of Germany

[73] Assignee: Losenhausen Maschinenbau AG, Dusseldorf, Fed. Rep. of Germany

[21] Appl. No.: 936,873

[22] Filed: Aug. 25, 1978

[30] Foreign Application Priority Data

Sep. 1, 1977 [DE] Fed. Rep. of Germany ..... 2739338

[51] Int. Cl.[2] ..... E01C 19/26

[52] U.S. Cl. ..... 404/121; 404/124; 404/117; 172/540; 301/43

[58] Field of Search ..... 404/117, 121, 124; 172/540, 547; 301/43, 44 R, 44 B

[56] References Cited

U.S. PATENT DOCUMENTS

| | | | |
|---|---|---|---|
| 1,395,432 | 11/1921 | Kroyer | 404/121 X |
| 2,358,863 | 9/1944 | Le Tourneau | 404/121 |
| 2,776,532 | 1/1957 | Buchholz | 404/121 X |
| 3,245,478 | 4/1966 | Thompson | 404/121 X |
| 3,252,391 | 5/1966 | Dils | 404/121 |
| 3,255,682 | 6/1966 | Hedstrom | 404/117 |
| 3,412,659 | 11/1968 | Harbke | 404/121 |
| 3,605,583 | 9/1971 | Keppler | 404/117 |
| 3,890,056 | 6/1975 | Domenighetti | 404/117 |

FOREIGN PATENT DOCUMENTS

| | | | |
|---|---|---|---|
| 865491 | 3/1971 | Canada | 404/121 |

*Primary Examiner*—Nile C. Byers, Jr.

*Attorney, Agent, or Firm*—Laney, Dougherty, Hessin & Beavers

[57] ABSTRACT

A vibratory compacting roller adapted to be coupled to a prime mover and equipped with hydrostatic driving and vibration exciting means, both drivingly connected to a hydraulic power generator located on said prime mover, is provided with recessed tamping elements distributed in parallel adjacent rows around the periphery of the roller cylinder face with a peripheral offset between adjacent rows. The tamping elements are of trapezoidal design with a semi-circular recess extending centrally from the base to the short side, said recess rendering a vibrational compacting roller with tamping elements equal in weight to a plain vibratory compacting roller of the same over-all diameter.

1 Claim, 3 Drawing Figures

VIBRATORY COMPACTING ROLLER

BACKGROUND AND SUMMARY OF THE INVENTION

The invention relates to a vibratory compacting roller for earth construction work comprising a hollow roller journalled in a frame, drive means for advancing said roller, vibrating means for vibrationally exciting said roller and coupling means on said frame to provide for driving connection of said vibratory compacting roller including said drive means and said vibrating means to a prime mover for driving and actuating said vibratory compacting roller on a respective working area, said hollow roller being provided with tamping elements projecting in parallel adjacent rows from the cylinder face thereof.

Vibratory compacting roller assemblies of this kind are employed in earth work particularly in road construction for the purpose of compacting and levelling the subgrade while simultaneously breaking up pieces and plates of stone and rock contained in the subgrade. Usually, different types of such assemblies equipped with different compacting rollers are used successively in adaptation to respective working requirements. Since different types of rollers have different weights, the power generator for driving the roller and the vibration exciter thereof has to be adapted to each respective roller to ensure that sufficient drive power and vibrating power is available for each respective roller. This is particularly true in the case of vibratory compacting rollers equipped with tamping elements mounted to the cylinder face of said rollers and plain vibratory compacting rollers which require different driving powers and vibrating powers because of their different weights.

The object of the invention is to provide a vibratory compacting roller of the aforementioned kind which does not require a change in the power generator if exchanged for a plain vibratory compacting roller of comparable size. It is also an object of the invention to provide for a vibratory compacting roller equipped with tamping elements on the cylinder face thereof which is vibrated by the same exciter as used with a plain vibratory compacting roller of comparable size without loss in effective vibratory power.

Particularly, the object of the invention is to provide for a vibratory compacting roller equipped with tamping elements on the cylinder face thereof which has a weigth comparable to the weight of a plain vibratory compacting roller of the same overall diameter.

And another object of the present invention is to provide an improved tamping element for road rollers.

Yet another object of the present invention is to provide an improved roller drum having parallel rows of staggered tamping elements.

Other and further objects of the present invention will be apparent to those skilled in the art upon a reading of the specification in conjunction with the accompanying drawings.

GENERAL DESCRIPTION OF THE DRAWINGS

DETAILED DESCRIPTION OF A PREFERRED EMBODIMENT OF THE INVENTION

Figure 1:
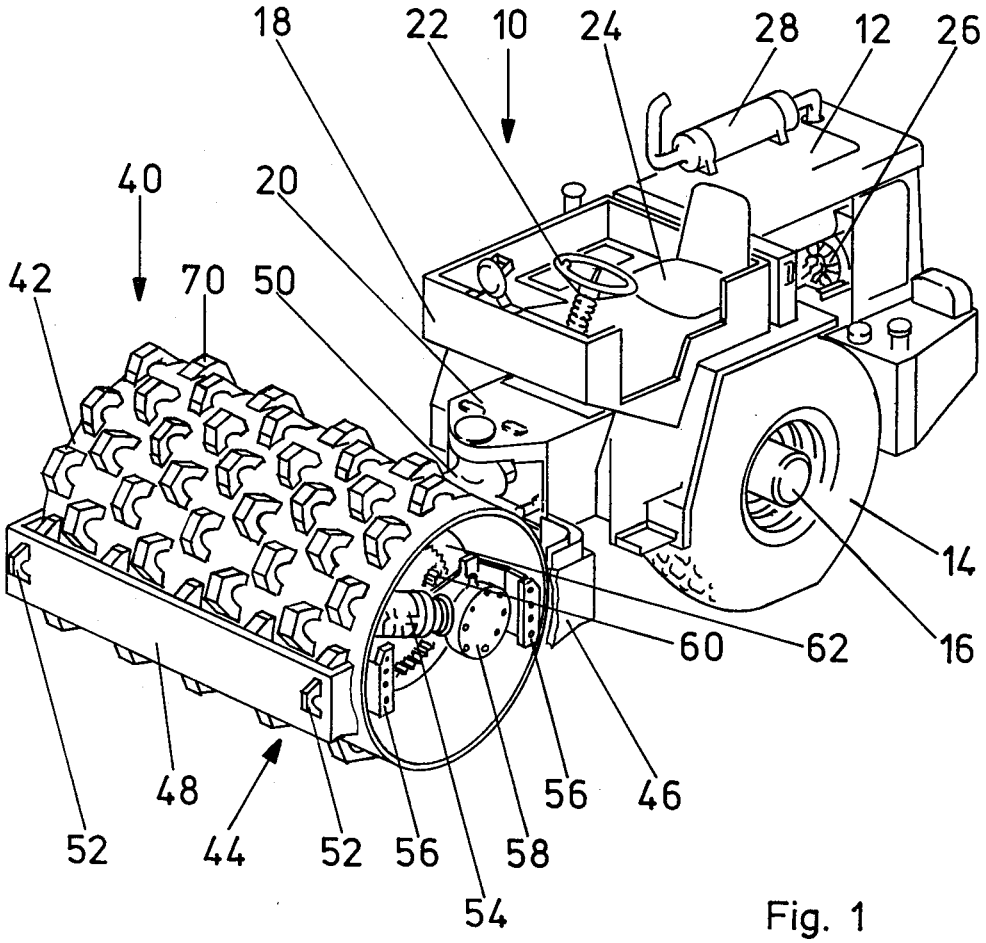
FIG. 1 is a perspective view of a road construction work assembly comprising an appropriate prime mover and a vibratory compacting roller according to the invention.

With reference to FIG. 1 of the drawings, there is shown a road construction work assembly comprising a prime mover generally designated by reference numeral 10 coupled to a vibratory compacting roller generally designated by reference numeral 40. As shown, prime mover 10 is a one-axle tractor 12 supported on one pair of wheels of which one wheel 14 mounted to the axle 16 is in view. Axle 16 carries a frame 18 the front end of which is equipped with coupling means 20 for drivingly connecting vibratory compacting roller 40 to tractor 12. The front portion of the frame 18 of tractor 12 is provided with a steering mechanism including steering wheel 22 and a driver's seat 24. Also, the front end portion of frame 18 includes various adjustable controls, not shown, arranged within the working range of the driver to operate the prime mover 10 and the vibratory compacting roller 40 in accordance with respective working requirements. The rear portion of the frame 18 of tractor 12 carries the power generating means for driving the assembly and for exciting the vibratory compacting roller 40. The primary engine of the power generating means is a diesel enging 26 provided with an exhaust 28. A secondary hydraulic power generator, not shown, is also supported on the rear portion of frame 18, said hydraulic power generator being adapted to be coupled to the primary engine 26 for power transfer. Pressure fluid lines (not shown) extend from the hydraulic power generator through frame 18 and coupling means 20 to the vibratory compacting roller 40. Associated control lines, not shown, extend to controls also arranged within the working range of the driver for operating the vibratory compacting roller 40.

Vibratory compacting roller 40 is a one-axle hollow roller 42 surrounded by a roller frame 44 in a median plane. Roller frame 44 is a rectangular frame composed of two pairs of opposing bars 46,48. One long-side bar 48 is provided with a coupling member 50 designed to be engaged to coupling means 20 at the front end of frame 18 of the tractor 12 so as to complete the driving connection between the prime mover 10 and vibratory compacting roller 40. The opposite long-side bar 48 is fitted with two lugs 52 each at one end thereof.

The means for driving and for exciting vibratory compacting roller 40 are disposed in the end spaces formed between the drums (not shown) and end covers (not shown) of roller 42. One such end space is shown in FIG. 1 to schematically indicate the drive means. In the end space a hydrostatic motor 54, sets of pressure fluid lines in blocks 56 and a miter gear 58 with a pinion 60 will be recognized as well as an annular gear rim 62 disposed coaxially around the inside of roller 42. The drive means are mounted to the roller frame 44 and pinion 60 is in driving engagement with gear rim 62 to drive roller 42.

The drive means for exciting the vibrator of roller 42 as well as the vibrator itself are disposed in the opposite end space of the roller which is out of view in FIG. 1. Generally, the vibrator is formed by an unbalance mass arranged to be rotated about the roller axle by means of another hydrostatic motor.

Power and control lines extend from the driving means and from the exciting means on roller 42 via roller frame 44 and coupling member 50 to the secondary hydraulic power generator and the controls, respectively, on tractor 12. The aforementioned assembly as described corresponds essentially to prior art tractor-roller-assemblies as utilized in road construction work and, therefore, is not described in greater detail. Various modifications are known in the art with respect to the prime mover 10 and with respect to the ways and means of driving the vibratory compacting roller 40 and the exciter thereon, however, generally the prime mover 10 will have a secondary hydraulic power generator, the driving means and the exciting means on vibratory compacting roller 40 being hydraulic drive means drivingly connected to said secondary hydraulic power generator.

The roller 42 of vibratory compacting roller 40 is provided with tamping elements 70 mounted to the cylinder outer cylindrical face of roller 42 in a staggered arrangement of parallel annular rows. According to the longitudinal section as shown in detail in FIG. 3 each tamping element 70 is of trapezoidal design having generally a short ground engaging side 72 and two legs 73 of equal lengths. The relatively long base thereof is not particularly designated by a reference number. This base is spaced radially inward from short side 72. A semi-circular recess 74 extends from the base towards the short side 72 symmetrically with respect to the mid-point of said base. Thus two stems 75 remain which have curved end faces adapted to the curvature of the cylinder face of roller 42. The acute edges formed at the joint line of legs 73 and stems 75 are cut off to form truncated edge faces 76.

Figure 2:
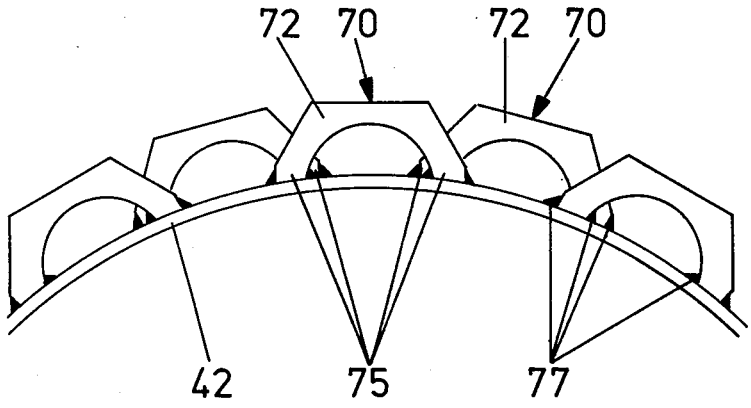
FIG. 2 is a side view of a portion of the vibratory compacting roller as shown in FIG. 1.
Figure 3:
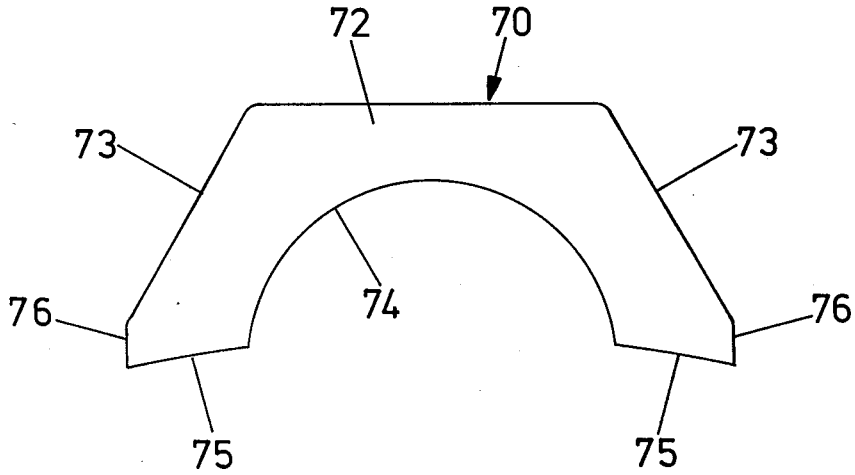
FIG. 3 is a longitudinal section through one of the tamping elements as mounted on the cylinder face of the vibratory compacting roller shown in FIG. 1.

While FIG. 3 shows a longitudinal section through one of the tamping elements 70 on roller 42, FIG. 2 shows the arrangement of two rows of such tamping elements on the cylinder face of roller 42 in a side view. The stems 75 are welded to the cylinder face of roller 42 as at 77. The arrangement is such that the tamping elements form two groups of peripheral or annular rows and axial lines on the cylinder face so as to yield a staggered arrangement in peripheral as well as in axial direction (see FIG. 1), the peripheral distance between members of each row being equal and the peripheral off-set between members of adjacent rows being just half said peripheral distance. Thus the tamping elements 70 of each row are said to be substantially equally peripherally spaced. As seen in FIG. 2, the stems 75 of one row of tamping elements 70 peripherally extend into the (axially off-set) region capped by the recess 74 of the tamping elements 70 in the adjacent row while the peripheral gap formed between the members of one row is (in axial off-set) edged by the members of the adjacent row. Using a roller body with an over-all outer diameter of the cylinder face amounting to 1.40 m (4 ft. 7 in), the peripheral distance between adjacent members within one row of tamping elements 70 corresponds to an angle of 30 degrees while the peripheral off-set between adjacent rows corresponds to a 15 degree angle.

The tamping elements 70 are cut from heavy gauge sheet metal having a length of 8 cm (corresponding to about 3⅛ in) by means of a cutting torch controlled such that blocks of the kind as shown in longitudinal section in FIG. 3 are obtained. The height by which the tamping elements 70 project from the cylinder face of roller 42 amounts to 10 cm (approx. 4 in.). By virture of recess 74 the weight of tamping element 70 is reduced to one half of the weight of a corresponding tamping element cut from solid material. However, in spite of the considerable reduction in weight thus obtained and in spite of the cavity formed by recess 74 below the working faces of tamping elements 70 neither the crushing action exerted particularly through the leading edge of the tamping elements on stone and rock material in the soil under compaction is impaired nor is there a risk of the tamping elements 70 becoming deformed under the action of the forces which become effective thereon.

A number of objects and advantages result from designing vibratory roller 40 in accordance with the invention. The weight reduction achieved by the novel tamping elements is such that the weight of the roller 42 is about equal to the weight of a plain vibratory compacting roller of the same overall diameter. Therefore, the power required for advancing such rollers is the same which means that the same drive means can be utilized to drive either one which reduces the number of components in manufacturing such rollers. A primary advantage, however, resulting from the weight reduction is associated with the vibrational exciter. Since the crushing and compacting efficiency obtained by using vibratory compacting rollers depends mainly on the jump height achieved under the action of the vibrational exciter and since an increase in weight means less jump height and less efficiency, different vibrational exciters had to be employed with rollers of different weights. The vibratory compacting roller 40 according to the invention has the same weight as a corresponding plain vibratory compacting roller so that the power requirements for vibrating such rollers are the same and the same vibrational exciters can be used on both types of rollers. This will simplify the manufacture of the rollers because of the reduction in the number of components required therefor. Another added advantage gained is that different types of rollers like a plain vibratory compacting roller and a vibratory compacting roller according to the invention may be readily exchanged at a given prime mover 10 because the hydraulic power generator present on said prime mover will at any rate suffice to drive and to vibrationally excite a roller like vibratory compacting roller 40 to render the respectively desired compacting power.

What is claimed is:

1. A roller drum, for compacting rollers, said roller drum comprising:

a cylindrical roller; and a plurality of substantially trapezoidal shaped tamping elements disposed about an outer cylindrical surface of said roller, each of said tamping elements having disposed therein a recess open towards said outer cylindrical surface;

wherein said trapezoidal shaped tamping elements include:

a ground engaging side;

a base including two stems having curved end faces adapted to the curvature of the outer cylindrical surface of the roller, said base being longer than said ground engaging side and spaced radially inward from said ground engaging side; and two legs of substantially equal length joining said ground engaging side and base; and wherein an acute edge formed at a joint line between one of said legs and one of said curved end faces is cut off to form a truncated edge face.

* * * * *